United States Patent [19]

Buzzard

[11] 4,046,342

[45] Sept. 6, 1977

[54] WAYSIDE SIGNALING SYSTEM FOR RAILROAD CAB SIGNALS AND SPEED CONTROL

[75] Inventor: Kenneth J. Buzzard, Pittsburgh, Pa.

[73] Assignee: Westinghouse Air Brake Company, Swissvale, Pa.

[21] Appl. No.: 719,337

[22] Filed: Aug. 31, 1976

[51] Int. Cl.[2] ..... B61L 21/06; B61L 21/08

[52] U.S. Cl. ..... 246/34 R; 246/63 R; 246/187 B; 246/187 C

[58] Field of Search ..... 246/34 R, 63 R, 63 C, 246/63 A, 167 R, 187 B, 187 C

[56] References Cited

U.S. PATENT DOCUMENTS

| | | | |
|---|---|---|---|
| 3,402,289 | 9/1968 | Burke | 246/187 B |
| 3,501,629 | 3/1970 | Aiken | 246/187 B |
| 3,868,075 | 2/1975 | Blazek | 246/63 C |

FOREIGN PATENT DOCUMENTS

| | | | |
|---|---|---|---|
| 1,951,048 | 5/1971 | Germany | 246/187 B |

*Primary Examiner*—Trygve M. Blix
*Assistant Examiner*—Reinhard J. Eisenzopf
*Attorney, Agent, or Firm*—A. G. Williamson, Jr.; R. W. McIntire, Jr.

[57] ABSTRACT

A transmitter and a receiver are located at each junction location between adjoining track sections along a stretch of track for transmitting and receiving cab signal or speed control commands through wire loops laid in a preselected pattern parallel to and between the rails of each section. Train carried apparatus is selectively reponsive to the speed commands and to the pattern of the wire loops to control the movement of the train in the established direction through the stretch. A distinct directional frequency is transmitted from the selected entrance end of the stretch, when a train movement is desired, and is repeated at each wayside location through the wire loops to the exit end. The directional frequency reception at each location activates a filter output to selectively enable gating elements to connect the associated transmitter and receiver to the adjoining section loops in accordance with the desired traffic direction. The speed command transmission is selected in accordance with the advance traffic conditions. If the immediate advance section is occupied by a train, a restricted speed command is transmitted in the principal loop of the approach section but no command is applied to a second loop at the exit end which causes the train to halt prior to entering the next section. This prevents the overrun of sections by a following train and the inadvertent reception of a higher speed command intended for the preceding train.

9 Claims, 4 Drawing Figures

WAYSIDE SIGNALING SYSTEM FOR RAILROAD CAB SIGNALS AND SPEED CONTROL

BACKGROUND OF THE INVENTION

My invention relates to a wayside signaling system for controlling cab signals and/or speed control apparatus carried on vehicles traversing a fixed roadway. Specifically, the invention pertains to a fail-safe wayside arrangement by which speed or cab signal commands are transmitted to railroad trains through wire loops load between and parallel to the track rails while retaining all the safety characteristics inherent in the transmission of such commands through the rails.

Although the transmission of speed and cab signal commands through the rails of the railroad track is an inherently failsafe arrangement, due to train rail shunts, it does occasionally create or build-in problems, particularly in electrified rapid transit systems. The use of wire loop arrangements to carry such commands can eliminate many of these problems and disadvantages. Among the advantages of using the loop transmitting system are negligible noise in the transmitted speed commands induced by propulsion current, cab signal sneak paths through bond connections are not as probable, the train apparatus does not have to respond to such a wide range of cab signal intensity or voltage levels, and the complications of physical attachment through some type of track bonds to the rails is eliminated. A principle objection to the use of wire loops obviously is that the signal carried therein is not shunted by the train moving through the stretch. Therefore, a following train could receive the same speed command as the leading train in the same signal block. This problem may be overcome by application of a stop command, indicating a very low speed limit, in the loops in the approach section to an occupied track section and by a preselected arrangement of loops, i. e., their pattern and positioning. A relatively fail-safe pattern for such wire loops is disclosed in the copending patent application, Ser. No. 719,336, having a common assignee and filed the same date as this application by Thomas J. Bourke and Kenneth J. Buzzard for a Transmitting Loop Arrangement for Railroad Cab Signal and Speed Control System.

Accordingly, an object of my invention is a wayside signaling system using wire loops for controlling cab signal or speed control apparatus on vehicles traversing a stretch of fixed roadway.

Another object of this invention is control circuitry for cab signal transmitting loops along a stretch of railroad track which provides fail-safe operation of the speed control apparatus on trains traversing that track.

Still another object of my invention is a train control signaling system for transmitting speed commands from wayside locations to control apparatus on trains traversing a stretch of track, using wire loops positioned in a predetermined pattern parallel to the rails of the stretch.

A further object of the invention is a wayside signaling arrangement for a railroad cab signal and speed control system which establishes traffic direction through a stretch of single track and supplies speed commands to trains traversing that track in accordance with the established traffic direction, with all traffic and speed signals transmitted through wire loops positioned between and parallel to the rails.

It is also an object of my invention to provide wayside control circuits for transmitting cab signal or speed control commands to trains traversing a stretch of single track in either direction, with train detection provided by track circuits but the speed commands transmitted through wire loops laid in a predetermined pattern between the rails, the control circuits being designed to provide positive train stops prior to entering an occupied track section.

A still further object of the invention is a speed control system for trains traversing a stretch of railroad track in either direction in which the speed commands are transmitted through wire loops laid betweeen the rails for inductive pickup by train carried apparatus, the loops being positioned in a predetermined pattern and supplied with control commands in a manner to provide fail-safe operation of the trains in response to advanced traffic conditions along the stretch of track.

Other objects, features, and advantages of the invention will become apparent from the following specification and appended claims when taken in connection with the accompanying drawings.

SUMMARY OF THE INVENTION

In practicing my invention, I utilize a wire loop pattern for transmitting cab signal and speed commands based on the loop patterns disclosed in the previously cited application Ser. No. 719,336. Specifically, the arrangement shown in FIG. 1 of this copending application is used but fully modified for two direction operation. In other words, the principal or first loop along the track center line is provided with an offset portion at each end of the track section. Also a second loop is used along the center line at each end of the section paralleling the offset portion of the first loop. The source and control apparatus for the cab signal and speed control commands at each junction between sections are selectively connected to the loops in accordance with the established traffic direction. That is, a cab signal transmitter and receiver are selectively connected to the loops at the established section exit and entrance ends, respectively. Signals used to establish traffic direction are also transmitted through the loops. Specifically, in accordance with a desired traffic direction, a first or a second direction frequency signal is transmitted from the selected entry end of the stretch and is passed by repeater units at each wayside location to the exit end of the stretch. This directional frequency signal is also received at each intermediate location by a directional filter unit responsive only to the corresponding direction frequency. The responsive filter unit, when activated upon receipt of a directional signal, supplies an enabling or gating signal for initiating the cab signal command transmission into the approach section loops and activating the receiver channels to receive and decode signals received through the advance section loop. The reception of the traffic direction signal at the exit end inhibits the transmission of the opposite direction frequency and also blocks the clearing of the opposing entrance signal into the stretch. At the exit end also, this traffic direction signal reception initiates the transmission of the cab signal and speed control commands into the first loop of the final approach section, that is, the section in which trains will be approaching the exit end.

Trains are detected in each track section by a track circuit shown specifically as an alternating current track circuit using the commercial frequency source. Section occupancy is registered at one end by a conventional track relay and is repeated to the other end of the section to a track repeater relay controlled by transmitting the same track current frequency over the first loop of the section. This superposing of track circuit frequency current on the loop does not interfere with the cab or speed commands. At each intermediate wayside location, that is, at each insulated junction between two adjoining track sections, transmitter and receiver units are coupled to the first and second loops of each section by coupling units which are normally inactive gating elements. These coupling units or directional gates are selectively activated by the directional filters in accordance with the traffic direction signal received. For example, a pair of coupling units are activated under an existing traffic condition to transmit the cab or speed commands developed by the transmitting unit into the first and second loops of the approach track section in the established traffic direction and to connect the receiver unit to accept the speed commands from the first loop of the advance track section. The traffic direction frequency signal is passed by a repeater unit which is coupled between the first loops of each of the adjoining sections in a manner to bypass the coupling units. Each receiver unit passes the received speed commands to a bank of filters which act as decoders. These decoders distinguish between the signal characteristics received and selectively pass the signal to one of a bank of code generators. The code generators transmit a related signal command, normally the next higher or equal speed level, to the transmitter for modulation of the cab signal frequency and subsequent transmission into the approach track section loops. When a train occupancy in the advance track section is detected by the track circuit, the occupancy register relay, that is, either the track relay or the track relay repeater, deactivates the receiver unit and directly selects the lowest speed command to modulate the cab signal frequency for transmission into the approach section loops.

The selected speed command is transmitted from the transmitter direct into the first loop in the approach track section. Normally the second loop also receives the same signal command. If the advance section is occupied, however, registration of such occupancy interrupts the transmitter connections to the second loop of the approach section. Thus, no signal is passed through the second loop and an approaching train halts within the selected offset length. This is possible since, under the occupied condition of the average section, the lowest speed command is being transmitted into the first loop of the approach section. This restricted or stop speed limit must be no higher than that which will allow the train to automatically halt within the preselected length of the offset portion which is equal to the length of the second loop. This wayside system thus controls the cab signal, speed control apparatus on the trains traversing the track stretch in a manner disclosed in the previously cited application Ser. No. 719,336. A similar wayside operation is provided at the end locations where the train enters or exits the single track stretch. The directional frequency, however, is not passed by the repeater units at these locations, such repeaters being tuned to pass only train performance level signals. At each end location, both directional filters are connected to the same first loop, that is, of the first section into the single track stretch. In other words, there is no directional signal in the first loop of the interlocking or station section although speed commands are still transmitted through this section from the exit end in accordance with the established traffic direction in the advance stretch of single track.

BRIEF DESCRIPTION OF THE DRAWINGS

I shall now describe a specific arrangement embodying the features of my invention and then define the novel features thereof in the appended claims. During the description, reference will be made to the accompanying drawings in which:

Figure 1A:
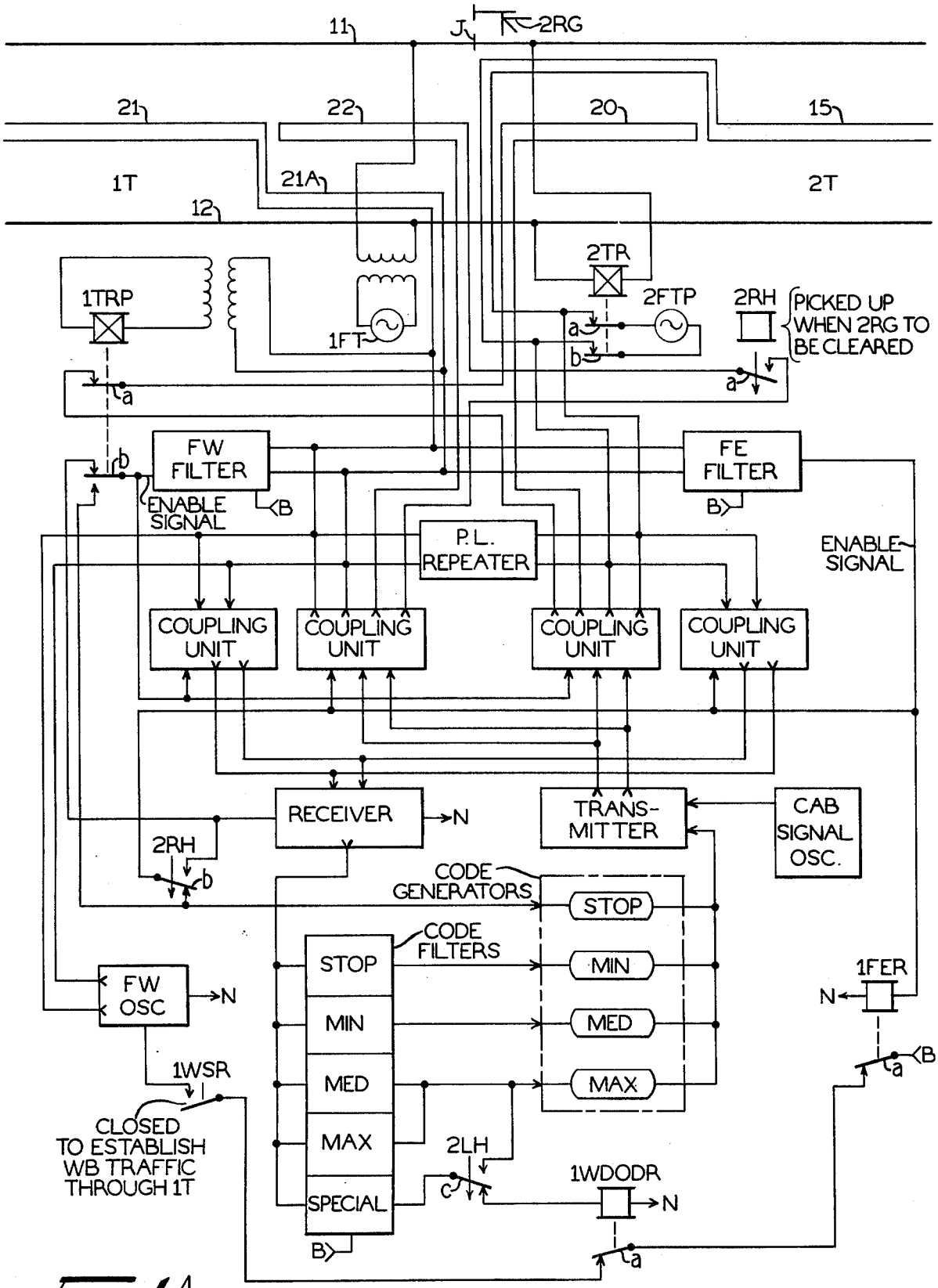
FIGS. 1A, 1B, and 1C, when taken together, provide a schematic circuit diagram illustrating a portion of a wayside cab signaling system embodying the invention as applied to a stretch of railroad track.

In each of the drawings, similar reference characters designate the same or similar parts or features of the apparatus. At each location along the wayside, a source of direct current energy for operating relays and other apparatus is provided. Several types of direct current sources are known and used in such signaling systems and therefore the specific source is not illustrated. However, the positive and negative terminals thereof and connections to them are designated by the reference characters B and N, respectively. The source of alternating current energy provided at each location for the track circuits and for the track repeater channels is illustrated by a conventional symbol such as, for example, the symbol designated as 1FT in FIG. 1A. These alternating current sources will normally be the commercial source of alternating current energy. Where it is necessary, in order to simplify the drawing layout, to illustrate relay contacts other than in vertical alignment with the operating winding, such contacts are designated by repeating the reference character for the relay and distinguishing that contact by a unique lower case letter. An example is the contact *b* of relay 2RH, shown at the lower left of FIG. 1A separate from the symbol for that relay operating winding. It is to be noted that contacts shown away from the operating winding may also be on a different drawing figure from that in which the operating winding is actually illustrated. The movable armature of all relay contacts, wherever shown, moves up to close against from contacts when the relay winding is energized.

DESCRIPTION OF THE ILLUSTRATED EMBODIMENT

Figure 1B:
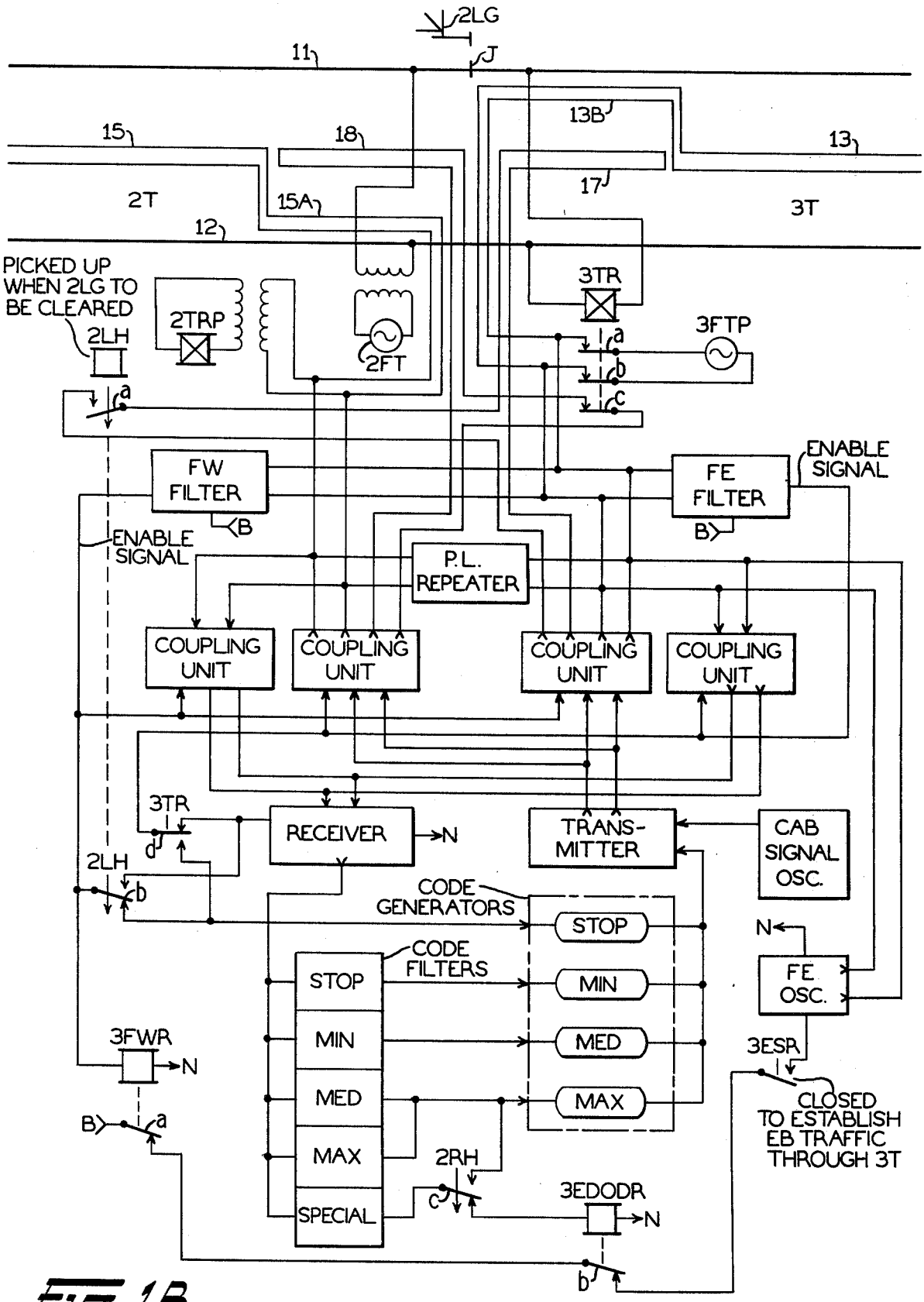
Figure 1C:
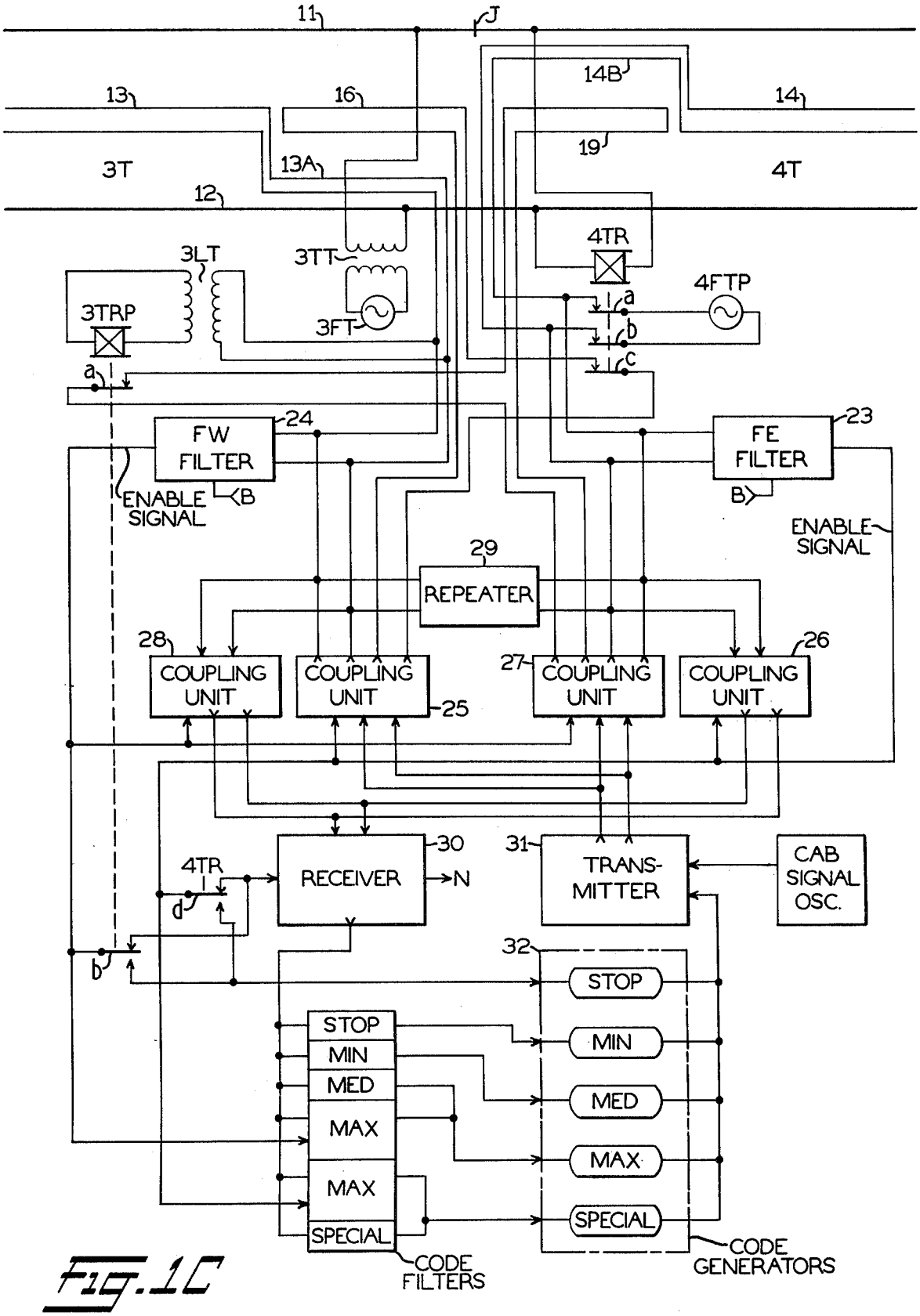

In describing my invention in detail, I shall refer first to FIGS. 1A, 1B, and 1C which, taken together in that order with FIG. 1A to the left, show a portion of a stretch of railroad track provided with a wayside signaling arrangement for controlling cab signals and speed control apparatus on trains traversing the track. Under special consideration, FIG. 1A may also be placed at the right of FIG. 1C to provide for another end location in the stretch of track. Portions of the stretch of track are shown across the top of the three drawing figures by the solid lines 11 and 12, each of which represent, in a conventional manner, one rail of the track. When these lines 11 and 12 are placed in alignment, the wire loop pattern for the transmission of cab signal commands will also be completed. Trains move in either direction through the stretch of track with the direction from left to right being considered as eastbound and the opposite, of course, westbound. The portion of track shown is divided into track sections by the insulted joints J in rail 11, with sections 1T, 2T, 3T, and 4T being shown from left to right. Section 2T is an interlocking or station section at which wayside signals 2RG and 2LG control the movement of trains into the interlocking and into the following stretch of single track. In other words, within section 2T, there may be a station platform and also various switches and diverging tracks by which trains may be routed to other tracks or routes. For purposes of the description, signal 2RG is considered to govern train movements in an eastbound direction from section 1T through the following or advance sections 2T, 3T, and 4T and thence to the right. Signal 2LG governs the movement of westbound trains into section 2T and thence through section 1T and subsequent sections in that direction. The wayside signals are shown by conventional symbols and their specific controls are not shown as they do not form a part of the present invention.

Track circuits are used to detect train occupancy of the various track sections shown. Since insulated joints appear only in rail 11, the so-called single rail track circuits are specifically used. This is conventional and frequency used where the trains are electrically propelled. As a specific example, the track circuit for section 3T, which laps FIGS. 1B and 1C, is supplied with a source of energy 3FT, shown in FIG. 1C by a conventional symbol as an alternating current source. This is considered to be the commercial frequency source so that there will be no interference with any of the other frequencies used in the speed control system. Source 3FT is coupled to rails 11 and 12 of section 3T by the track transformer 3TT. At the other end of section 3T, track relay 3TR is connected directly across the track rails and is, of course, normally energized when no train is occupying this track section. So that the track section occupancy condition can be registered at each end of the second, a track circuit repeater arrangement is provided. At the west end of section 3T, a source of alternating current energy 3FTP, normally the commercial source, is connected across the first or principal wire loop 13 of section 3T by front contacts *a* and *b* of relay 3TR. At the other end of section 3T, the track repeater relay 3TRP is coupled across the loop by the loop transformer 3LT. Obviously, when section 3T is unoccupied, repeater relay 3TRP is energized because rack relay 3TR is energized and both relays remain in their picked up position to register the nonoccupancy of the section. Conversely, a train shunt within the section causes both relays to release to register the occupied condition. Similar track circuits are provided for each other track section with that for section 2T being shown in its entirety while only a partial showing is provided for sections 1T and 4T. If FIG. 1A is placed to the right of FIG. 1C, the track circuit portions for sections 4T and 1T may be combined as an illustration of the complete track circuit arrangement for an eastern end section of a stretch of railroad track between interlocking or station locations.

Each section is also provided with wire loops to provide channels for the transmission of cab signal or speed commands. For example, section 3T has a main or first loop 13 which is a two wire closed loop located generally along the track center line or midpoint and parallel to the rails. This loop begins at the transmitter unit at one end and terminates in the receiver unit at the other end, in accordance with the traffic direction, as will be described later in the specification. Loop 13 is provided at each end of the section with an offset portion of a preselected length and positioned immediately adjacent the right-hand rail for trains exiting the section at that end. These offset portions are designated 13A for eastbound trains and 13B for westbound. This preselected length is equal to the stopping distance for a train moving through the section at the lowest speed limit. This lowest speed limit is herein designated the STOP speed and is defined as a crawling or restricted speed level of 5 mph or less. Parallel to the offset portion of the first loop and of the same preselected length, a second or auxiliary loop is laid along the track center line at each end of the section, the loops 16 and 17. Each of these is a closed circuit loop energized from a transmitting unit at the same location when that end of the section is the exit for a traffic route. The pattern of these loops is similar, as previously mentioned, to that described in copending application Ser. No. 719,336 and the same reference characters are used in order to provide an easy comparison for this section 3T. A similar loop pattern is provided for each other section including section 2T, the station or interlocking track section. The reference numerals used for the loops in sections 2T and 4T are also the same as those used in the cited copending application. Although not shown herein, the train carried apparatus which responds to signal commands carried in these loops may be the same as that shown in FIG. 2 of the cited copending application and reference is made thereto for a description of the operation of the train carried cab signal, speed control apparatus since this apparatus is not a specific part of the invention defined herein.

I refer now to FIG. 1C in which is illustrated a typical intermediate wayside location at a junction between two adjoining track sections, here sections 3T and 4T. This location includes apparatus for detecting trains or registering the occupancy of both track sections and for the reception and transmission of loop signal commands in accordance with the established traffic direction and the advance traffic conditions. The overall track circuit apparatus has already been described. Here relays 3TRP and 4TR register the occupancy of sections 3T and 4T, respectively, by trains. The loop arrangement for each section has also been previously described. Shown at the FIG. 1C location are the first loops 13 and 14 with their offset portions 13A and 14B, respectively, and second loops 16 and 19. Coupled to the first loops 14 and 13 are the directional filter units 23 and 24, respectively, and connected between these loops is a repeater unit 29. Each directional filter unit is tuned to one or the other of the distinct directional frequencies FE and FW. For example, filter 23 is tuned to respond only to the frequency FE which is transmitted to establish the eastbound traffic direction. When this frequency is present in the first loops, filter 23 responds to output an enabling signal for various coupling units and other elements in a manner to be shortly described. These filter units are shown by conventional block since any known solid state circuitry which will provide the operation desired may be used and the specific details are not part of my present invention.

It is to be noted that these filters will respond to no other signal than that to which they are tuned and each is coupled to the loop over which the directional signal will be received by repeater unit 29. For example, FE filter 23 is coupled to loop 13 by repeater unit 29. In this manner, the reception of a directional signal by a filter unit also checks that the associated repeater unit is in operable condition. This repeater unit 29 is provided with filter elements which will pass only frequencies FE and FW and other distinct frequencies used as performance level signals in the system. Repeater 29 retransmits such signals at a high level through the next loop in order to assure the transmission of such signals from one end to the other of the stretch. Unit 29 is also shown by a conventional block since any known circuitry may be used which will provide the operation desired. The so-called performance level commands or signals are those which may be used to control the transmission of wayside speed commands at a lower level than justified by traffic conditions in order to adjust train schedules or the headway between successive trains. Such signals may also be received by the train apparatus to establish a temporary maximum speed limit lower than the allowable speed or to direct the train to bypass a station stop. This performance level signal transmission arrangement is not specifically shown herein since the use of such signals, particularly transmitted through the rails, is conventional and not part of my invention. It will be noted that the repeater units at the home signal locations, i. e., each end of the interlocking section 2T, are tuned to pass only the performance level (P.L.) commands and not the directional frequency signals.

Each intermediate location also has a receiver and a transmitter unit, such as receiver 30 and transmitter 31 in FIG. 1C, for receiving the speed commands and for transmitting, through the approach section loops new speed commands in accordance with the traffic conditions. The transmitter has associated therewith a bank of code generators and a cab signal oscillator. This latter unit, in FIG. 1C, is shown as a conventional block since any known oscillator circuit may be used which will provide a carrier frequency for the transmission of the speed commands, normally in the audio frequency range but at a higher frequency if desired or required. Code generators, shown by conventional symbols within the dot-dash rectangle 32, each generate a specific or distinct signal command, for example, in a range from 5 to 22 Hz, which represents a specific speed level. The speed ranges are here designated as the maximum (MAX), medium (MED), minimum (MIN), and STOP speed levels. The MAX speed command allows train movement at whatever maximum speed for the transportation system is established. The medium speed level will, for example, be on the order of 30 to 35 mph, while a minimum speed level will require the train to reduce to a speed of no more than 15 to 20 mph. The STOP speed command requires or authorizes a train to move only at a crawling speed of 5 mph or less so that it may stop within a very short distance, e.g., the offset loop preselected length. The SPECIAL command signal is interpreted by the train carried apparatus as the equivalent of a MAX speed command. It is used under special wayside conditions to allow a clearing out or resetting of an established traffic direction. The code commands and the cab signal frequency are both applied to the transmitter unit where the command signals modulate the cab signal carrier frequency. The modulated carrier is then amplified and transmitted by the transmitter unit through the selected wayside loops. Various circuit arrangements for generating the code speed command signals are known in the railway signaling art. Thus these code generating units are shown in a conventional manner since the specific details are not part of the present invention and the use of such will be understood by those skilled in the art.

Each receiver unit is tuned to respond only to the cab signal frequency and, when enabled by a signal from the active directional filter, is operable to demodulate the cab signal carrier and produce a coded output signal representing the code or speed command frequency modulated onto the cab signal carrier at the transmitter. The output from the receiver is applied to a bank of code filters, one for each code rate. Each of these filters, shown by a conventional block, is tuned to pass only the assigned code rate frequency as designated by the symbol inside the conventional block. The output of each code filter is applied to actuate one of the associated code generators in a manner in which will be shortly described. Each of the code filters is normally a simple filtering circuit tuned to pass only the assigned code rate but may, under special conditions as specifically shown in FIG. 1C, require an enabling signal to be operable to pass the assigned frequency.

The transmitter and receiver units at each location are coupled to the track loops by coupling units such as 25 to 28 shown in FIG. 1C. These coupling units, shown conventionally by blocks, are basically known gating devices which require an external enabling signal to become conductive. These enabling signals are selectively supplied by the directional filters FE and FW to alternate pairs of the coupling units. Referring to FIG. 1C, when the eastbound traffic direction is established, the coupling units 25 and 26 are enabled by the FE filter 23 by application of the output of this unit to the coupling unit enabling gates. When coupling unit 25 is enabled, that is, the circuit is closed, transmitter 31 is connected to loop 13 of approach section 3T and also to the second loop 16 of that same track section. The connections from the transmitter to loop 16 also include front contact *c* of relay 4TR. Receiver 30 is likewise connected, when gate 26 is enabled, to first loop 14 of advance section 4T. It will be noted that second loop 19 of advance section 4T is deactivated at this time but this is immaterial, in accordance with the operation of the train apparatus, since the offset portion 14B will provide signals to an eastbound train. When westbound traffic direction is established, coupling units 28 and 27 are enabled by the output from FW filter 24 so that transmitter 31 is connected to loops 19 and 14 of approach section 4T and receiver 30 is connected to loop 13 of advance section 3T. It is to be noted that the output from FE filter 23 is also applied over front contact *d* of relay 4TR to enable receiver 30 during eastbound traffic conditions while the output of FW filter 24 is applied over front contact *b* of relay 3TRP to enable receiver 30 when westbound traffic exists.

If section 4T is occupied by an eastbound train, relay 4TR is of course released. The open front contact *d* of relay 4TR then interrupts the supply of the enabling signal from FE filter 23 to receiver 30 so that, even though coupling unit 26 is enabled, receiver 30 is not responsive to the signal received from loop 14 through coupling unit 26. However, the enabling signal from filter 23 is applied over contact *d* of relay 4TR to the STOP code generator, activating this element to supply its unique code rate frequency to transmitter 31. This actuates the transmission of a STOP code modulated on the cab signal frequency over loop 13 of section 3T since coupling unit 25 is also enabled at this time. However, the open front contact *c* of relay 4TR interrupts transmission of this STOP signal to loop 16 so that this loop is deactivated or deenergized under these conditions. As previously indicated, a second eastbound train approaching through section 3T at the very slow STOP speed will respond to the deenergized condition of loop 16 to halt within the preselected length of this second loop.

In a similar manner, if westbound traffic is established and section 3T occupied, relay 3TRP releases since relay 3TR at the exist end of section 3T is also released. Front contact *b* of 3TRP is thus open, interrupting the supply of an enabling signal from FW filter 24 to receiver 30 but the corresponding back contact *b* is closed to apply this signal to the STOP code generator of bank 32. Receiver 30 is thus non-responsive to any signal received from loop 13 through coupling unit 28, which is enabled, but transmitter 31, through coupling unit 27, supplies the cab signal carrier modulated by the STOP code signal to loop 14 of section 4T. However, front contact *a* of relay 3TRP is open to interrupt the supply of this particular code rate to loop 19 of section 4T. As previously described, when auxiliary loop 19 has no signal flowing therein, a westbound train approaching at the STOP speed will halt within the length of this second loop, short of entering the next track section 3T.

The apparatus at each end of the interlocking track section 2T is similar to that at the intermediate locations. For example, each location at the end of section 2T includes a receiver and a transmitter unit with the associated code filters and code generators. The transmitter and receiver are coupled to the various track loops through gating type coupling units as at the intermediate locations. Each such location has a directional filter for each direction of traffic and a repeater unit which incidently passes only the performance level signal frequency. However, the directional filter units at each location in FIGS. 1A and 1B are connected to the main loop in the first track section outside of the interlocking zone. For example, in FIG. 1B, the FE and FW filter units are each connected to loop 13 in section 3T. Correspondingly, in FIG. 1A these directional filters are connected to loop 21 in section 1T. In addition, the directional filter terminating the traffic direction into the interlocking also controls a directional relay with its output or enabling signal. For example, the FW filter at the east end of section 2T (FIG. 1B) energizes a directional relay 3FWR when the westbound frequency is received. When relay 3FWR is energized and picks up, it registers the establishment of a westbound traffic direction through the stretch of track terminating at the west end of section 3T. In other words, relay 3FWR registers when a train movement westbound through the stretch and entering section 2T at the location of signal 2LG is permitted. Although not specifically shown, when the registry of westbound traffic is established, that is, relay 3FWR is picked up, it inhibits the clearing of the eastbound signal 2RG (FIG. 1A). In a similar manner, the corresponding eastbound traffic direction relay 1FER (FIG. 1A) at the other end of the interlocking, when energized by the corresponding FE filter, picks up to inhibit the clearing of westbound signal 2LG. Each directional relay also inhibits, as will be explained, the establishment of the opposite direction traffic by preventing the generation of the opposite direction traffic frequency.

A directional frequency oscillator is provided at each interlocking location. For example, in FIG. 1A, the FW oscillator provides a signal of that frequency while in FIG. 1B, the FE oscillator provides a signal of the eastbound frequency. Each of these oscillators is thus the source of the directional signal for establishing the traffic for trains leaving the interlocking at that particular location. Each oscillator is shown by a conventional block since any known type of oscillator which will generate or produce a signal of the desired frequency and energy level may be used. In FIG. 1B, the FE oscillator is directly connected to loop 13 for transmitting a signal through that loop to establish eastbound traffic when the oscillator is activated. This oscillator is energized or activated when a contact 3ESR is closed in order to selectively establish eastbound traffic through the stretch of track beginning at section 3T. This energizing circuit also checks that the reception of the corresponding westbound frequency has not been registered at that location by including back contact *a* of relay 3FWR. The energizing circuit also includes back contact *b* of an eastbound stretch clear registry relay 3EDODR which picks up to turn off the FE oscillator when the circuit arrangement is clearing out after the passage of an eastbound train and the traffic direction is being cancelled.

FW oscillator at the other end of the interlocking section 2T is controlled in a similar manner, the energizing circuit including back contact *a* of relay 1FER, to assure that the corresponding eastbound frequency has not been registered, back contact *a* of a relay 1WDODR, which opens when the stretch has been cleared by a westbound train, and a contact 1WSR which is closed when the establishment of westbound traffic through the stretch beginning with section 1T is desired. The FW oscillator is connected to loop 21 of section 1T to transmit the westbound frequency throughout the stretch. It may be noted that an equivalent arrangement to that shown in FIG. 1A is provided to the right of FIG. 1C at the eastern end of the stretch of track including sections 3T and 4T.

At each end of the interlocking location, that is, at each end of section 2T, signal relays responsive to the position or condition of the signals 2RG and 2LG, governing entry into the interlocking, control the application of the STOP speed command to the first loop of the approach track section to the interlocking and the interruption of the transmission of any signal command in the second loop of the corresponding section. For example, when westbound signal 2LG shown in FIG. 1B is displaying a STOP indication, the associated signal relay 2LH is released. The illustrated front contact *a* of relay 2LH interrupts the application of speed command signals to loop 17 in section 3T which is appropriate since any approaching train in this section must stop before it passes the signal. Over back contact *b* of relay 2LH, the enable signal from the FW filter is applied to the STOP command generator so that the signal transmitted in loop 13 by the transmitter carries the STOP or restricted speed command to an approaching train in section 3T. Thus the speed command supplied to westbound trains approaching in section 3T directly depends, at least in part, upon the condition of signal 2LG and not upon the occupancy of section 2T as reflected by relay 2TR. Of course, the clearing of signal 2LG is dependent upon the non-occupancy of all track sections immediately in advance of the signal. Loops 15 and 18 in section 2T, however, are controlled in the usual manner for transmitting speed commands to eastbound trains approaching through section 2T, whose continued progress is dependent upon the occupancy condition of section 3T.

In FIG. 1A, relay 2RH responds to the condition of the eastbound signal 2RG. When this signal displays STOP, front contact *a* of relay 2RH interrupts the transmission of speed commands into loop 22 while back contact *b* of this relay transfers the enabling signal from the FE filter to the STOP code generator in the code generator bank. Thus the transmitter modulates the STOP command onto the cab signal carrier which is transmitted into loop 21 to control the approach of the eastbound trains. When signal 2RG is in a proceed position, so that relay 2RH is picked up, the speed command transmitted into loop 21 and also into loop 22 depends upon the speed command received through loop 15 in section 2T which in turn depends, in the usual manner, upon traffic conditions in section 3T and beyond.

Figure 2:
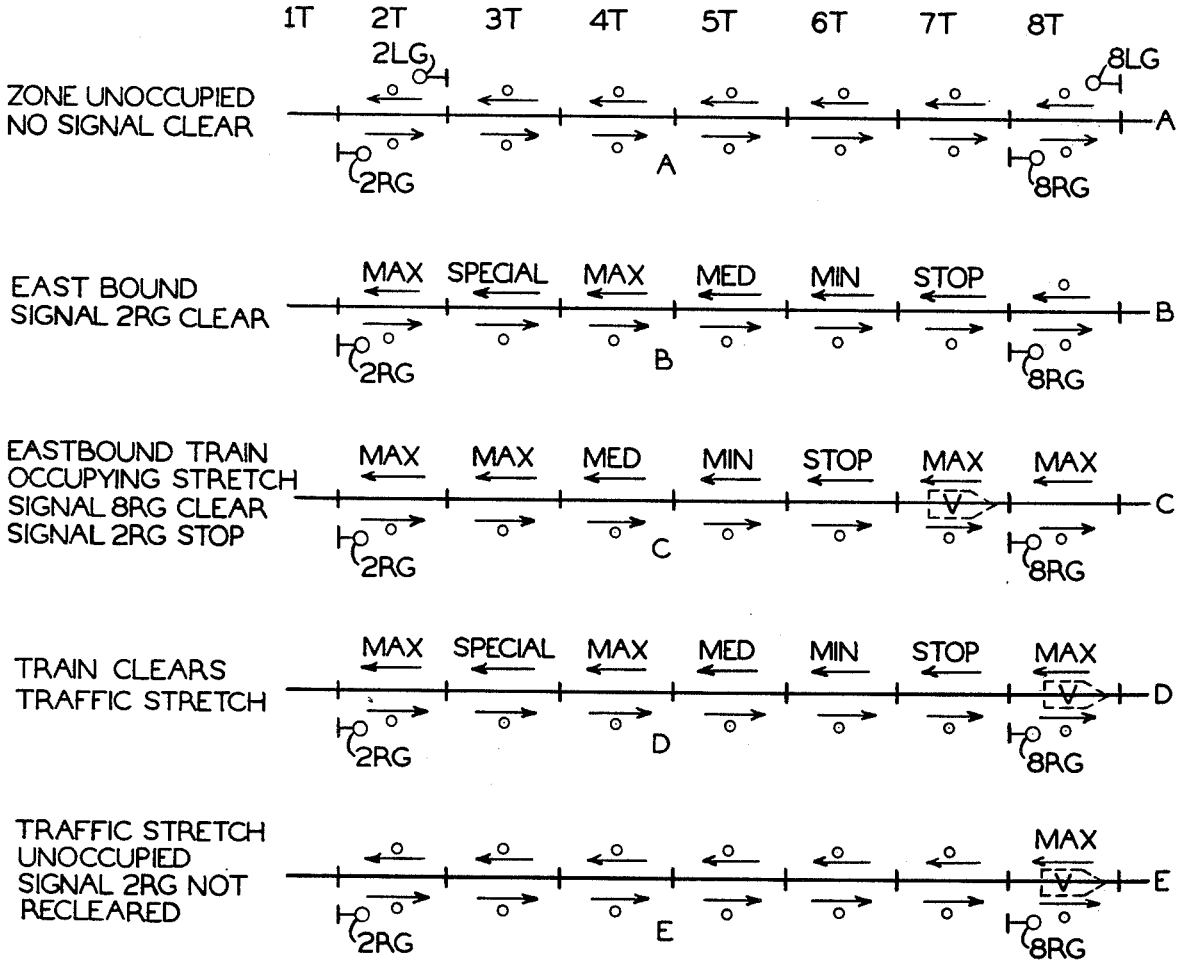
FIG. 2 is a chart showing the flow of speed command signals in the principal loops of the stretch of track during several specific traffic or operating conditions.

Before briefly describing the operation of the illustrated system, I shall refer to FIG. 2. The same stretch of railroad track is shown in each of the charts A to E of this drawing figure by a single line symbol. This stretch of track is divided by insulated joints, conventionally shown, into a plurality of track sections designated across the top of the drawing as sections 1T through 8T. Since the charts are vertically aligned these section designations apply to each stretch of track illustrated. Sections 1T through 4T correspond the section illustrated at least in part in FIGS. 1A, B, and C. Sections 5T to 8T of FIG. 2 extend to the right or east and have the same or similar wayside apparatus. Section 2T is of course the interlocking or station control section with signals 2RG and 2LG as shown in the various portions of FIG. 1. For controlling each direction of train movement, section 8T is a similar interlocking section at the east end of the stretch and includes signals 8RG and 8LG for governing eastbound and westbound movements, respectively. In using the charts of FIG. 2, it is to be noted that the apparatus shown in FIG. 1A may also be used to represent the wayside apparatus at the junction of sections 7T and 8T. Each of the five charts illustrates a different condition of speed command signal transmission in the track loops in accordance with the different traffic occupancy conditions. The arrow associated with each track section designates the signal flow and the associated reference designates the type of command being transmitted. For example, in chart A, with no traffic direction established, no speed command signals are being transmitted in any section, as designated by the zero (0) symbol associated with each arrow. In chart B, a MAX speed code command is being transmitted through section 2T from the east end of the section in accordance with the apparatus shown in FIG. 1B.

Chart A of FIG. 2 illustrates the at-rest condition of the apparatus for the stretch of track. In other words, neither traffic direction is established and no train occupies any of the track sections. Under this situation, no cab signal or speed commands are transmitted into any section in any direction. By reference to FIGS. 1A and B, it will be seen that the FE and FW oscillators are inactive since the ESR and WSR contacts are open, no request having been made for the establishment of a traffic direction. With no frequency FE or FW signal being transmitted, direction filters at each location are inactive and thus produce no enable signal. Lacking such an enabling signal, the coupling units or gating circuits are not closed to couple the associated transmitters and receivers to the track loops. Thus no speed command can be transmitted nor can any signal be received from the loops by the local apparatus at any wayside location.

It is now assumed that an eastbound train is to move through this stretch of track from section 2T to section 8T. The dispatcher or control operator handling this stretch of track initiates the clearing of signal 2RG and/or the establishment of the eastbound traffic direction through the stretch. This may be a combined action in accordance with the traffic control system in use. In any event, contact 3ESR, shown in FIG. 1B, is closed in response to the request for the train movement. The directional signal frequency FE is transmitted to loop 13 but is blocked by the P.L. repeater unit from being transmitted into loop 15 of section 2T. At the next wayside location, FIG. 1C, this eastbound or FE directional signal is retransmitted by repeater unit 29 into loop 14. Directional signal FE is similarly repeated at each intermediate wayside location and eventually received at the east end of section 7T. For example, referring to the arrangement for sections 1T and 2T in FIG. 1A as being the equivalent to that of sections 7T and 8T, the FE filter is then activated and enables the coupling units to connect the receiver to the first loop 15 of section 8T and the transmitter to the first loop 21 of section 7T. With signal 8RG not cleared, a STOP command is transmitted into loop 21 of section 7T and the connections to second loop 22 are interrupted so that this loop remains deenergized. This action is controlled by a signal relay 8RH and its contacts *a* and *b* in a manner similar to that described for relay 2RH.

With reference to FIG. 1C, the reception of the STOP command by the receiver unit at the first location to the west of the interlocking, that is, at the west end of section 7T where it adjoins section 6T, actuates the STOP code filter. This in turn enables the MIN code generator to produce a code signal which the transmitter modulates onto the cab signal oscillator output. Since eastbound traffic direction is in effect, coupling units such as 25 and 26 in FIG. 1C are enabled so that the output of the transmitter is connected to the first and second loops of section 6T to transmit the MIN speed command eastward through this section. At the next junction location between sections 6T and 5T, reception of the MIN speed command activates the MIN code filter which in turn causes the MED code generator to produce a signal which, modulated onto the cab signal carrier, is then transmitted in the first and second loops eastward through section 5T. At the junction location between sections 4T and 5T, reception of the MED speed command causes the code filters to produce a signal which actuates the code generators to produce a MAX code signal which is transmitted in the first and second loops of section 4T.

At the junction between sections 3T and 4T, which is specifically shown in FIG. 1C, the MAX speed command is received by receiver 30 which is coupled by unit 26 to loop 14. With the enabling signal being applied from filter 23 to the lower of the two MAX code filters shown, the output of this filter, as the result of the received code, actuates the SPECIAL code generator. This code command is modulated onto the cab signal carrier and transmitted eastward in loops 13 and 16 of section 3T. It is to be noted that, at the previously described junction locations between the track sections, reception of a MAX speed command can activate only the single MAX code filter provided, for example, as shown in FIG. 1B. This in turn causes the associated MAX code generator to be activated and transmit a similar speed command into the eastbound track section loops. However, at the junction location in FIG. 1C, it is necessary to provide a SPECIAL code command to distinguish between the traffic directions and to actuate certain responsive actions at the interlocking location.

With the FE filter at the section 2T–3T junction (FIG. 1B) activated, the associated eastbound coupling units are enabled as is the receiver unit since front contact *d* of relay 3TR is closed. Reception of the SPECIAL code command at the location shown in FIG. 1B causes the SPECIAL code filter to produce an output. Since the clearing of signal 2RG has been requested, relay 2RH is picked up and its front contact *c* applies this output to the MAX code generator so that the transmitter, being connected to loops 15 and 18, supplies a MAX speed command in the loops of section 2T. At the other end of section 2T, shown in FIG. 1A, the eastbound direction signal received through loop 21 of section 1T activates the FE filter which in turn provides a signal to enable the receiver unit over front contact *b* or relay 2RH. The MAX speed command received through loop 15 by the receiver is supplied to the code filters, activating the MAX filter which in turn applies its output to the MAX code generator for further application of this code rate signal to the transmitter. Accordingly, a MAX speed command is transmitted via the transmitter through loops 21 and 22 of section 1T. This replaces the STOP speed command in loop 21 previously transmitted prior to the clearing of the eastbound signal 2RG. Reception of this speed command at the west end of section 2T also allows signal 2RG to now clear to permit the eastbound train movement to pass into section 2T and thus into the stretch of track in the eastward direction. It may be noted that, had signal 2RG clear not been requested, relay 2RH would be released and, upon the reception of a SPECIAL code command at the location in FIG. 1B, the output of the SPECIAL code filter would be applied over back contact *c* of relay 2RH to energize relay 3EDODR.

When the eastbound train accepts the proceed indication on signal 2RG and enters section 2T, the signal is returned to its stop indication and the clear request is cancelled. This operation is conventional so that the signal does not automatically reclear for a following train. Relay 2TR releases due to the shunt on the rails of section 2T and in turn deenergizes relay 2TRP shown in FIG. 1B. Relay 2RH is also deenergized but is provided with slow release characteristics in order not to interrupt, at its front contact *c* in FIG. 1B, the transmission of a MAX speed command into loops 15 and 18 of section 2T while the train tranverse that section. It may be noted that, under most conditions, this interlocking or station section 2T will be of considerably shorter length than the intermediate sections such as 3T and 4T. When this train enters section 3T, track relay 3TR releases and in turn deenergizes relay 3TRP which also releases. The opening of front contact *d* of relay 3TR removes the enabling signal from the receiver unit which is thus deactivated. Meanwhile, the closing of back contact *d* of relay 3TR supplies the enabling signal to the STOP code generator and this speed command is now transmitted into loop 15. However, with front contact *c* of relay 3TR also open, loop 18 is interrupted and thus deenergized.

As the train continues through section 3T and enters section 4T, track relay 4TR obviously releases. The shifting of contact *d* of this relay from its front to back position removes the enabling signal from receiver unit 30 and applies the same signal to activate the STOP code generator. The STOP speed command is now transmitted into loop 13 of section 3T by transmitter 31 but the connection to loop 16 is interrupted at the open front contact *c* of relay 4TR. Similar actions occur as the train enters each new track section as it progresses in the eastward direction. Chart C of FIG. 2 illustrates the speed command transmission condition when this train is occupying section 7T.

In considering the operations at the various junction locations when the condition of chart C exists, reference is made to the arrangement shown in FIG. 1C as being typical of each intermediate location. With section 7T occupied, a STOP speed command is then transmitted in the first loop of section 6T. However, the second loop of section 6T is deenergized by the fact that relay 7TR is released. Thus a following train moving through section 6T will be necessity advance at a STOP or restricted speed so that it will stop over the second loop due to the absence of any loop signal. Since section 6T is unoccupied, its track relay 6TR will be picked up so that the receiver unit at the junction between sections 5T and 6T is enabled by the FE filter output. The STOP command received through the first loop of section 6T and applied to the receiver unit is passed by the associated code filters, specifically the STOP code filter, to actuate the MIN generator associated with the corresponding transmitter. Thus a MIN speed command is transmitted into both loops of section 5T. At the next section junction to the west, where sections 4T and 5T are adjoining, the MIN speed command received by the receiver unit is passed by the MIN code filter to actuate the MED code generator. This results in the MED speed command being transmitted through section 4T as indicated in chart C of FIG. 2. At the junction between sections 3T and 4T, the MED speed command received results in the transmission through loops 13 and 16 of section 3T of a MAX speed command. At the interlocking exit, i.e., the junction between sections 2T and 3T, reception of the MAX speed command actuates the MAX code generator and both loops 15 and 18 in section 2T receive the MAX speed command signal.

When the train moves into section 8T and clears section 7T, signal 8RG having previously been cleared, the conditions shown in chart D of FIG. 2 pertain. Transmission of the various speed commands moves one section to the east from that shown in chart C. Even if the dispatcher stores a control to reclear signal 8RG, relay 8RH will remain released at the present to activate the STOP code generator which results in the transmission of such a speed command to the first loop of section 7T. Referring now to FIG. 1C, that is, the actual junction between sections 3T and 4T, the MAX speed code command received through loop 14 is applied to receiver 30. With the FE filter 23 active, this receiver unit together with the eastward coupling units are enabled. Similarly, the lower MAX code filter element shown in the bank below receiver 30 is likewise enabled. Since there is no output from the corresponding FW filter 24, the upper MAX code filter is inactive at this time. Thus the only output from the code filters is from the lower MAX unit which is then applied to the SPECIAL code generator in bank 32. This code rate is applied to transmitter 31 and, modulated onto the carrier, then through coupling unit 25 to loops 13 and 16 of section 3T.

At the interlocking location shown in FIG. 1B, if signal 2RG is not now cleared, the SPECIAL code filter output, over back contact *c* of relay 2RH, energizes relay 3EDODR. Pick up of relay 3EDODR to open its back contact *b* interrupts the circuit energizing the FE oscillator at this location, which then ceases to apply the FE directional signal to loop 13. The absence of this directional signal causes the apparatus throughout the whole stretch to clear out, canceling the eastbound direction previously established. This results in renewal of the at-rest condition of the apparatus as shown in chart E even though this train has not yet cleared section 8T at the east end of the stretch. The operation of the apparatus for a westbound train, including the establishment of westbound traffic direction, is quite similar and will be obvious by reference to the preceding description and to the accompanying drawings. Therefore a specific description is omitted.

The apparatus of my invention thus provides a wayside control arrangement for train carried cab signal or speed control apparatus using wire loops along the track to transmit cab signal or speed commands for pickup by the train receivers. This avoids any interference between the propulsion current and the transmitted speed commands since they flow in separate channels. Speed commands transmittedare selected in accordance with advance traffic conditions which are determined by the registered occupancy of the advance track section and the character of the speed command received over the advance section first loop. Because of the offset of the main loop at the exit end of each section and the provision of a second loop, a train is automatically halted prior to entry into an advance section occupied by a preceding train. The following train thus does not overrun the section junction to inadvertently receive the speed command signal being transmitted for the first train. Thus a safe and reliable speed control system for railroad trains results.

Although I have herein shown and described but a single arrangement of a wayside signaling system for railroad cab signals and speed control embodying features of my invention, it is to be understood that various changes and modifications may be made therein within the scope of the appended claims without departing from the spirit and scope of my invention. Having now described the invention, what I claim as new and desire to secure by Letters Patent is:

1. A wayside signaling arrangement for a stretch of railroad track for controlling train carried cab signal apparatus on trains traversing the stretch in either direction, said stretch divided into a plurality of sections between station locations, comprising in combination, a. a plurality of wire loops laid between the rails of each section and positioned in a predetermined pattern to inductively couple with said train carried apparatus to transmit cab signal commands thereto, b. a cab signal command transmitter means at each junction location between adjoining sections selectively coupled to the wire loops in an adjoining approach section, in accordance with the established traffic direction, for transmitting cab signal commands selected in accordance with advance traffic conditions, c. a receiver means at each junction location, selectively coupled to the wire loops in an adjoining advance section in accordance with the established traffic direction and always to the section loops other than those to which the associated transmitter means is coupled, for receiving the cab signal command transmitted by the transmitter means at the next junction in advance, d. cab signal command selection means at each location coupled between the associated receiver and transmitter means and responsive to the cab signal commands received by said associated receiver means from the advance section loops for activating said associated transmitter means to transmit a cab signal command into the approach section loops in accordance with the advance traffic conditions represented by the received cab signal commands, and e. traffic direction register means at each junction location coupled to the loops in each adjoining section and responsive to the reception of a unique signal from one approach direction loop for registering the established traffic direction, f. said traffic direction register means responsive to the registration of a traffic direction for enabling the coupling of the associated transmitter and receiver means to the correct loop pattern in accordance with the traffic direction established.

2. A signaling arrangement, as defined in claim 1, which further includes, a. coupling gates at each location for selectively connecting the corresponding transmitter and receiver means to the loops of adjoining sections when the gates are selectively enabled in accordance with the traffic direction, and in which the traffic direction registor means at each location comprises, b. a repeater device coupling the loop patterns in the adjoining sections for passing first and second distinct traffic signals generated at the one end and the other end of said stretch, respectively, to designate traffic direction, only one of said distinct signals being present at any one time, c. a first filter unit coupled through said repeater device to the loops of the approach section from said one end and responsive only to said first distinct signal for generating an enabling signal, d. a second filter unit coupled through said repeater device to the loops of the approach section from said other end and responsive only to said second distinct signal for generating an enabling signal, e. said first and second filter units coupled for selectively enabling said coupling gates to connect said transmitter and receiver means to the loop patterns in the approach and advance sections, respectively, in accordance with the distinctive signal received to establish the traffic direction at the location.

3. A signaling arrangement, as defined in claim 1, which further includes, a. a train detector circuit means for each track section coupled for registering at each end of the corresponding section the occupied or unoccupied condition of that section,

1. each location including a portion of the occupancy register for each adjoining section, and in which, b. each train detector means is direct coupled to the command selection means at each end of the corresponding section for activating the transmission of the most restricted command into the adjoining approach section loops when that corresponding section is occupied by a train.

4. A signaling arrangement, as defined in claim 3, in which, a. the plurality of wire loops in each section includes at least a principal loop and, along a preselected distance at each end, a second loop having a separate coupling to the transmitter means at that associated location, b. each train detector means controlling the approach section second loop transmitter coupling at each end of the corresponding section for interrupting the transmission of cab signal commands into the approach section second loop when the corresponding track section is occupied, c. the principal loop for each section coupled to the transmitter means at one or the other end of the section in accordance with the traffic direction for receiving the cab signal commands transmitted including the most restrictive command when the advance section is occupied, d. said preselected distance of said second loops being the stopping distance of a train from the most restricted speed level.

5. A signaling arrangement, as defined in claim 4, in which the cab signal command selection means at each location comprises, a. a decoding means coupled to the associated receiver means and responsive to received cab signal commands for producing one of a plurality of outputs corresponding to the actual command received, and b. a code generator means controlled by said decoding means for generating a selected cab signal command in accordance with the existing output of said decoding means and coupled for activating the associated transmitter means to transmit said selected cab signal command, and in which, c. the portion of each adjoining section train detector means at each location is coupled to the associated code generator means for generating the most restricted command for transmission by the associated transmitter means when the corresponding section is occupied and is the advance section for the established traffic direction.

6. In a wayside signaling arrangement for controlling train carried cab signal and speed control apparatus on trains traversing a stretch of railroad track in either direction, said stretch divided into a plurality of track sections, each with a predetermined pattern of wire loops laid between the rails in inductive relationship with the train carried apparatus to transfer signal commands thereto, at each junction location between adjoining sections, the combination comprising, a. a transmitter means at times coupled for transmitting cab signal commands over approach section loops selected in accordance with the established traffic direction, b. receiver means at times coupled to advance section loops selected in accordance with the established traffic direction for receiving the cab signal command transmitted from the next junction location in advance, c. a traffic registry means coupled to the loops of each adjoining section and responsive to a distinct traffic signal received from a selected end of said stretch for registering the established traffic direction, d. a gated coupling means controlled by said traffic registry means for selectively coupling the associated transmitter means and receiver means to the approach and advance section loops, respectively, in accordance with the registered traffic direction, e. a cab signal command selection means coupled to the associated transmitter and receiver means and responsive to the cab signal commands received from the advance section loops for activating the associated transmitter means to transmit cab signal commands into the approach section loops in accordance with advance traffic conditions.

7. A wayside signaling arrangement, as defined in claim 6, which further includes at each location, a. a separate train occupancy register means coupled to each adjoining section for registering the unoccupied and occupied conditions of that section, b. each train occupancy register means being coupled to said command selection means for selecting a most restricted speed command for transmission into the other section loops when the corresponding section is occupied and is the advance section in the established traffic direction.

8. A wayside signaling arrangement, as defined in claim 7, in which said cab signal command selection means comprises, a. a speed command code generator means coupled to the associated transmitter means for activating the transmission of a selected cab signal command into the approach section loops, and b. a decoding means coupled to the associated receiver means and responsive to the cab signal command received from the advance section loops for controlling the associated code generator means to select the cab signal command to be transmitted into the approach section in accordance with the advance traffic conditions, and in which, c. each associated train occupancy means is direct coupled to said code generator means for selecting the most restricted speed command when the corresponding advance section is occupied.

9. A wayside signaling arrangement, as defined in claim 8, in which the loop pattern in each section adjoining the location includes an auxiliary loop of preselected length at the adjacent end of the section, positioned for solely controlling train carried apparatus over its preselected length as a train exits from the corresponding section at that location, said preselected length being equal to the stopping distance of a train from the most restricted speed level, each train carried apparatus operable to stop that train if no signal is received from the auxiliary loop at the exit end of a section, further in which, a. each auxiliary loop is coupled to the associated transmitter means in accordance with the established traffic direction for normally receiving cab signal commands transmitted into the loops of the corresponding section for an approaching train, and b. each train occupancy register means at a location is connected for interrupting the coupling from the associated transmitter means to the other section auxiliary loop to actuate the stopping of an approaching train within the approach section in the established traffic direction when the corresponding advance section is occupied.

* * * * *